US009370067B2

(12) United States Patent
Bordin et al.

(10) Patent No.: US 9,370,067 B2
(45) Date of Patent: Jun. 14, 2016

(54) LED CONTROL CIRCUIT AND A CONTROLLING METHOD OF THE SAME

(75) Inventors: Luca Bordin, Munich (DE); Yuli Chen, Shenzhen Guangdong (CN); Wuqiang Liao, Shenzhen Guangdong (CN); Wei Tan, Shenzhen Guangdong (CN)

(73) Assignee: OSRAM GMBH, Munich (DE)

( * ) Notice: Subject to any disclaimer, the term of this patent is extended or adjusted under 35 U.S.C. 154(b) by 144 days.

(21) Appl. No.: 14/350,566

(22) PCT Filed: Aug. 27, 2012

(86) PCT No.: PCT/EP2012/066599

§ 371 (c)(1),
(2), (4) Date: Jun. 4, 2014

(87) PCT Pub. No.: WO2013/053532

PCT Pub. Date: Apr. 18, 2013

(65) Prior Publication Data

US 2015/0163877 A1 Jun. 11, 2015

(30) Foreign Application Priority Data

Oct. 14, 2011 (CN) ..... 2011 1 0312676

(51) Int. Cl.
*H05B 33/08* (2006.01)

(52) U.S. Cl.
CPC ..... *H05B 33/0827* (2013.01); *H05B 33/083* (2013.01); *H05B 33/0815* (2013.01); *H05B 33/0818* (2013.01); *H05B 33/0848* (2013.01)

(58) Field of Classification Search
CPC ..... H05B 33/0818; H05B 33/0827
USPC ..... 315/186, 217, 122, 297, 307
See application file for complete search history.

(56) References Cited

U.S. PATENT DOCUMENTS 8,264,453 B2 * 9/2012 Yang ..... H05B 33/0818 345/102
8,299,724 B2 * 10/2012 Huynh ..... H05B 33/083 315/291

(Continued)

FOREIGN PATENT DOCUMENTS

CN 201278600 Y 7/2009
CN 201307950 Y 9/2009

(Continued)

OTHER PUBLICATIONS

International Search Report issued in the corresponding PCT application No. PCT/EP2012/066599, dated Oct. 8, 2012.

(Continued)

*Primary Examiner* — Daniel D Chang
(74) *Attorney, Agent, or Firm* — Viering, Jentschura & Partner mbB

(57) ABSTRACT

An LED control circuit for controlling an LED illuminating device is disclosed. The LED illuminating device includes at least serially connected load group, and the LED control circuit includes: a conversion module configured to convert an input voltage to an output voltage, and to output a working current as a sample current; a reference voltage generating module configured to generate a reference voltage; a control module configured to compare a sample voltage corresponding to the sample current with the reference voltage, and to output a control signal to the conversion module according to a comparison result; and a load short circuit module including a plurality of switches each connected in parallel with respective load group for performing a short circuit control on respective load group in response to a switching signal. A controlling method of such LED control circuit is also disclosed.

11 Claims, 4 Drawing Sheets

(56) References Cited

U.S. PATENT DOCUMENTS

| | | | | |
|---|---|---|---|---|
| 2007/0257623 | A1 | 11/2007 | Johnson et al. | |
| 2007/0262724 | A1 | 11/2007 | Mednik et al. | |
| 2009/0153066 | A1 | 6/2009 | Yang et al. | |
| 2011/0254524 | A1 | 10/2011 | Ishii | |
| 2013/0002159 | A1 | 1/2013 | Chen et al. | |
| 2013/0049599 | A1* | 2/2013 | Logiudice ..... | H05B 33/083 315/122 |

FOREIGN PATENT DOCUMENTS

| | | | |
|---|---|---|---|
| CN | 201365198 | Y | 12/2009 |
| CN | 201479428 | U | 5/2010 |
| CN | 101896022 | A | 11/2010 |
| CN | 101932175 | A | 12/2010 |
| CN | 102065610 | A | 5/2011 |
| CN | 102076151 | A | 5/2011 |

OTHER PUBLICATIONS

English abstract of CN 101932175 A of Dec. 29, 2010.
English abstract of CN 101896022 A of Nov. 24, 2010.
English abstract of CN 201479428 U of May 19, 2010.
English abstract of CN 201307950 Y of Sep. 9, 2009.
English abstract of CN 102065610 A of May 18, 2011.
English abstract of CN 201365198 Y of Dec. 16, 2009.
English abstract of CN 201278600 Y of Jul. 22, 2009.
Office Action issued in the corresponding Chinese application No. 201110312676.0 dated May 8, 2014 with its English translation.

* cited by examiner

LED CONTROL CIRCUIT AND A CONTROLLING METHOD OF THE SAME

RELATED APPLICATIONS

The present application is a national stage entry according to 35 U.S.C. §371 of PCT application No.: PCT/EP2012/066599 filed on Aug. 27, 2012, which claims priority from Chinese application No.: 201110312676.0 filed on Oct. 14, 2011, and is incorporated herein by reference in its entirety.

TECHNICAL FIELD

Various embodiments relate to an LED control circuit for driving an LED illuminating device. In addition, various embodiments further relate to a controlling method of such LED control circuit.

BACKGROUND

At present, color mixing concept is widely used to obtain white light with expected CCT (correlative color temperature) and CRI (color rendering index). At the same time, it demands a higher requirement on electronic driver design. The electronic driver should be able to drive multiple LED strings. However, the electronic driver driving multiple LED strings should have good response to a dynamic load. In the prior art, the popular peak current control buck topology circuit is a good option for driving multiple strings because of its good response to dynamic voltage variation.

FIG. 1 is a typical fixed frequency peak current control buck topology circuit used for driving multiple strings. The relation between an output voltage and a current flowing through the strings may be obtained via the following formulas.

$$D = \frac{V_{out}}{V_{in}}, \qquad \text{Formula (1)}$$

wherein D is a duty cycle of a control signal, $V_{out}$ is an output voltage of the strings, and $V_{in}$ is an input voltage;

$$\Delta I = \frac{(V_{in} - V_{out}) \cdot D}{F_s \cdot L}, \qquad \text{Formula (2)}$$

wherein ΔI is a ripple current on an inductor L1, $F_s$ is a control signal, and $I_{pk}$ is a controlled peak current flowing through the inductor L1;

$$I_o = I_{pk} - \frac{1}{2}\Delta I, \qquad \text{Formula (3)}$$

wherein $I_o$ is a current flowing through the strings. Formula (4) $I_o = K1(V_{out}^2 - V_{in} \cdot V_{out}) + I_{pk}$ can be derived from Formulas (1), (2) and (3), wherein $$K1 = \frac{1}{2(F_s \cdot L \cdot V_{in})}.$$

A current-voltage chart shown in FIG. 2 can be easily obtained from Formula (4). As can be seen from FIG. 2, when this circuit is used to driver multiple strings, the current flowing through the strings also changes dynamically when the output voltage changes.

FIG. 3 shows the problems above by waveform. Assume that a transistor Q2 in the circuit shown in FIG. 1 is always turned off and a duty cycle of a converter is set to be 50%. At t1 period, a transistor Q3 is turned off, then the output voltage $V_{out}$ is a sum of the whole three strings, i.e., $V_{out}$=V_str1+V_str2+V_str3, and at t2 period, the transistor Q3 is turned on, then the output voltage $V_{out}$ is $V_{out}$=V_str1+V_str3. During the period when transistor Q3 is turned on, the output voltage $V_{out}$ decreases, which causes the ripple current ΔI to decrease. As the controlled peak current $I_{pk}$ flowing through inductor L1 always keeps constant by a current control loop, the current $I_o$, flowing through the strings increases according to Formula (2), while the increased current $I_o$ is undesired.

SUMMARY

In order to solve the problems above, various embodiments provide an LED control circuit for controlling an LED illuminating device. The LED control circuit can have a good response to a dynamic change of an output voltage of a load so as to keep a constant current flowing through the load. In addition, various embodiments further provide a controlling method of such LED control circuit.

According to various embodiments, the LED illuminating device includes at least two serially connected load groups, and the LED control circuit includes: a conversion module for converting an input voltage into an output voltage for the load groups, and outputting a working current of the load groups which is sampled to obtain a sample current; a reference voltage generating module for generating a reference voltage; a control module for comparing a sample voltage corresponding to the sample current with the reference voltage, and outputting a control signal to the conversion module according to a comparison result; and a load short circuit module including a plurality of switches each connected in parallel with respective load group for performing a short circuit control on the respective load group in response to a switching signal, wherein the LED control circuit further includes a reference voltage compensating module for generating a compensation voltage for compensating the reference voltage in response to the switching signal. According to various embodiments, a duty cycle of the control signal output from the control module is changed by compensating the reference voltage, as a result, the peak current is controlled, so that the current flowing through the load groups keeps constant. Therefore, the LED control circuit according to the present disclosure can well respond to the dynamic change of the output voltage of the load groups so as to keep a constant current flowing through the load groups.

According to various embodiments, the control module includes: a comparator for comparing the sample voltage with the reference voltage; and a pulse width modulator, connected with an output of the comparator, for generating a PWM signal as the control signal according to the comparison result. As the reference voltage is compensated, the duty cycle of the control signal is correspondingly changed; consequently, the peak current is controlled, so that the current flowing through the load groups is assured to keep constant.

According to various embodiments, the reference voltage compensating module includes a plurality of reference voltage compensating sub-modules connected in parallel with each other, wherein respective reference voltage compensating sub-module assigned to one switch of the load short circuit module, and respective reference voltage compensating sub-module and corresponding switch thereof are simultaneously controlled by a single switching signal. Thereby, the dynamic change of the output voltage of the load groups can be well responded to.

According to various embodiments, respective reference voltage compensating sub-module includes a second transistor and a compensating resistor, wherein the second transistor has a control Electrode receiving the switching signal, a working Electrode connected to a inverting input of the comparator via the compensating resistor, and a reference Electrode connected to ground. In this solution, when the switching signal is sent to one switch of the load short circuit module, the switch is turned on due to the high level of the switching signal, thus causing one load group to be short-circuited, and further leading to a change of the output voltage of the load group. At which time, the switching signal is also supplied to the second transistor, thus the second transistor is turned on, and further the reference voltage is lowered down, and the reference voltage is compensated.

According to various embodiments, the reference voltage compensating sub-module includes a second transistor and a compensating resistor, wherein the second transistor has a control Electrode receiving the switching signal, a working Electrode connected to a inverting input of the comparator via the compensating resistor, and a reference Electrode connected to a DC voltage source. In this solution, when the switching signal is sent to one switch of the load short circuit module, the switch is turned on due to the high level of the switching signal, thus causing one load group to be short-circuited, and further leading to a change of the output voltage of the load group. At which time, the switching signal is also supplied to the second transistor, thus the second transistor is turned on, and further the DC voltage source is turned on, and the reference voltage increases and is compensated.

According to various embodiments, the conversion module includes a first transistor, an inductor and a diode, wherein the first transistor has a control Electrode receiving the control signal, a reference Electrode connected to ground via a reference resistor, and a working Electrode connected to a node between an anode of the diode and one end of the inductor, a cathode of the diode and an input end of serially connected load groups are connected with the input voltage, respectively, and the other end of the inductor is connected with an output end of the serially connected load groups. The conversion module converts the input voltage to the output voltage for the load groups.

According to various embodiments, the reference voltage generating module includes a DC voltage source, a first resistor and a second resistor, wherein the first resistor has one end connected to the DC voltage source and the other end connected to a inverting input of the comparator; the second resistor has one end connected to a node between the inverting input and the one end of the first resistor and the other end connected to ground; a non-inverting input of the comparator is connected to a node between the reference Electrode of the first transistor and the reference resistor, and the sample current generates the sample voltage after flowing through the reference resistor.

According to various embodiments, respective switch of the load short circuit module is configured to be a third transistor, wherein the third transistor has a control Electrode receiving the switching signal, a working Electrode connected to an input end of one load group, and a reference Electrode connected to an output end of one load group. In one solution of the present disclosure, respective load group has a corresponding switch for performing a short circuit control thereon.

All of the switches and transistors mentioned in the solutions of the present disclosure may be configured to be MOSFET.

Various embodiments further provide a controlling method of the LED control circuit above. The method includes steps of: a) converting an input voltage to an output voltage for load groups by means of a conversion module, and outputting a working current of the load groups which is sampled to obtain a sample current; b) a switching signal controlling a switch of the load short circuit module by means of a switching signal to perform a short circuit control on one or more of the load groups; c) a reference voltage generating module generating a reference voltage; d) controlling the reference voltage compensating module by means of the switching signal to generate a compensation voltage for compensating the reference voltage; and e) comparing the sample voltage with compensated reference voltage by means of a control module, and adjusting a duty cycle of the control signal according to a comparison result so as to control a peak current flowing through the load groups, and outputting a constant working current. According to Formula (4) mentioned above, when the output voltage dynamically changes, the peak current can be dynamically adjusted with the controlling method according to the present disclosure, further assuring the working current flowing through the load groups to keep constant.

Preferably in step d), the second transistor of the reference voltage compensating module connected to ground is turned on in response to the switching signal, and further a compensation voltage decreasing the reference voltage is generated.

Optionally in step d), the second transistor of the reference voltage compensating module connected to the DC voltage source is turned on in response to the switching signal, and further a compensation voltage increasing the reference voltage is generated.

According to the chart shown in FIG. 2, assume that when an actual input voltage is smaller than half of the input voltage shown in the chart, the working current flowing through the load groups presents a descending trend; and when the actual input voltage is larger half of the input voltage shown in the chart, the working current flowing through the load groups presents a rising trend. Accordingly in one solution of the present disclosure, when the input voltage is smaller than half of the input voltage shown in the chart, the compensation voltage increasing the reference voltage is generated by turning on the second transistor connected to the DC voltage source, so as to assure the working current flowing through the load groups to keep constant. In another solution, when the actual input voltage is larger half of the input voltage shown in the chart, the compensation voltage decreasing the reference voltage is generated by turning on the second transistor connected to ground, so as to assure the working current flowing through the load groups to keep constant.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION OF

The following detailed description refers to the accompanying drawing that show, by way of illustration, specific details and embodiments in which the disclosure may be practiced.

Figure 4:
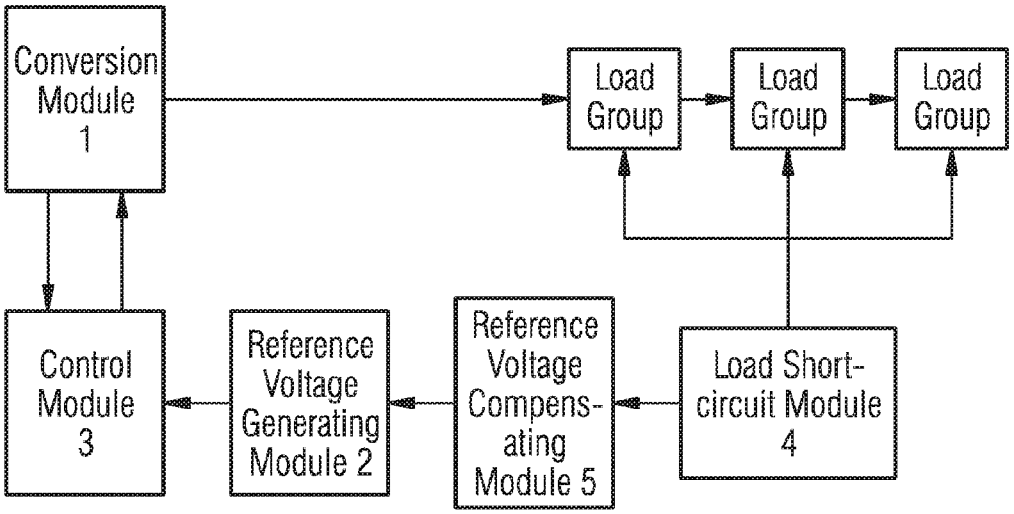
FIG. 4 is a principle block diagram of an LED control circuit according to the present disclosure.

FIG. 4 is a principle block diagram of an LED control circuit according to the present disclosure. As can be seen from FIG. 4, the LED control circuit according to the present disclosure comprises: a conversion module 1 for converting an input voltage $V_{in}$ to an output voltage $V_{out}$ for load groups $str_1, \ldots, str_n$, and outputting a working current $I_o$ of the load groups $str_1, \ldots, str_n$ as a sample current $I_{sense}$; a reference voltage generating module 2 for generating a reference voltage $V_{ref}$; a control module 3 for comparing a sample voltage $V_{sense}$ corresponding to the sample current $I_{sense}$ with the reference voltage $V_{ref}$, and to output a control signal BUCK_PWM to the conversion module 1 according to a comparison result; a load short circuit module 4 including a plurality of switches each associated with respective load group $str_1, \ldots, str_n$ for performing a short circuit control on respective load group $str_1, \ldots, str_n$ in response to a switching signal $PWM_str_1, \ldots, PWM_str_n$; and a reference voltage compensating module 5 configured to generate a compensation voltage $V_{comp}$ for compensating the reference voltage $V_{ref}$ in response to the switching signal $PWM_str_1, \ldots, PWM_str_n$. In one solution of the present disclosure, the switch may be configured to be MOSFET. According to Formula (4) mentioned in the preceding, when the output voltage $V_{out}$ dynamically changes, the working current $I_o$ flowing through the load groups $str_1, \ldots, str_n$ may be assured to keep constant just by adjusting a peak current $I_{pk}$. Thus, in one solution of the present disclosure, after comparing the sample voltage $V_{sense}$ with the compensated reference voltage $V_{ref}$, the control module 3 adjusts a duty cycle of the control signal BUCK_PWM according to a comparison result so as to control the peak current $I_{pk}$ flowing through the load groups $str_1, \ldots, str_n$, and outputting a constant working current $I_o$ flowing though the load groups $str_1, \ldots, str_n$ to keep constant.

Figure 1:
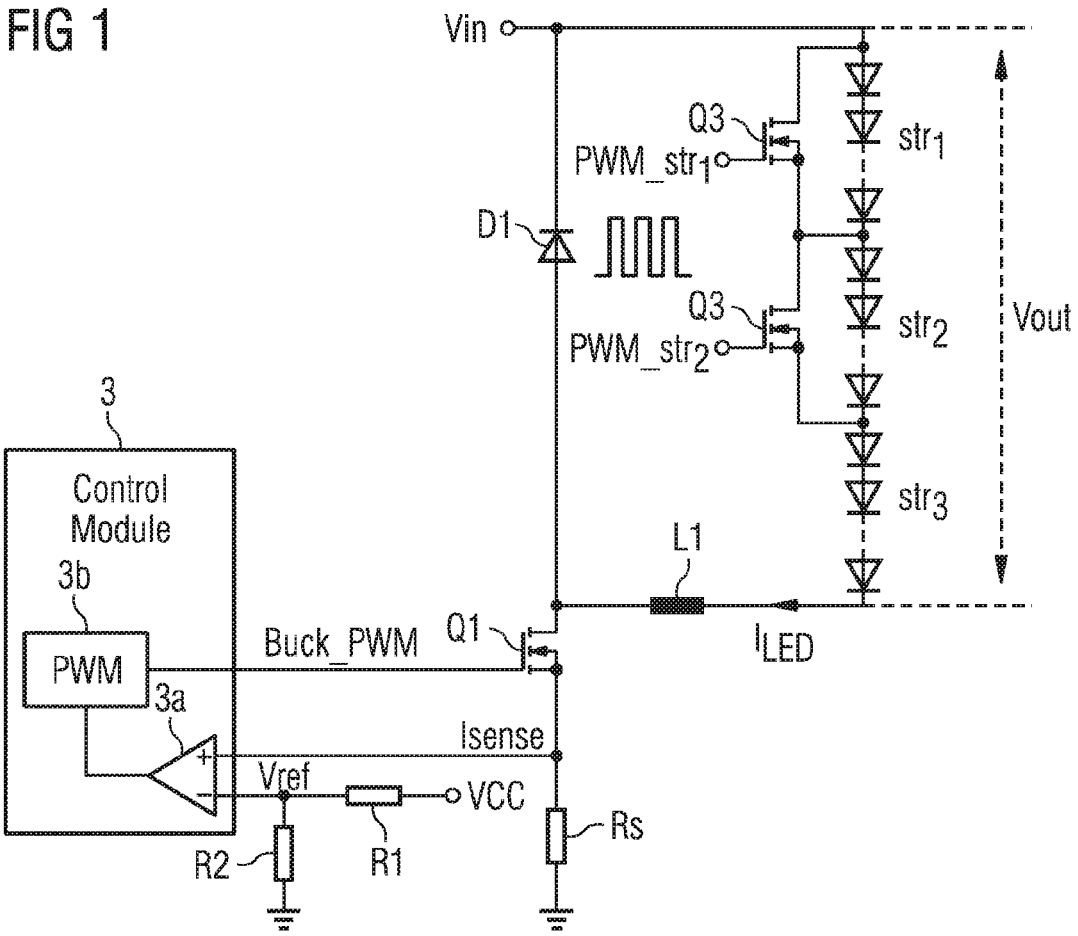
FIG. 1 is a circuit diagram of a related LED control circuit.
Figure 2:
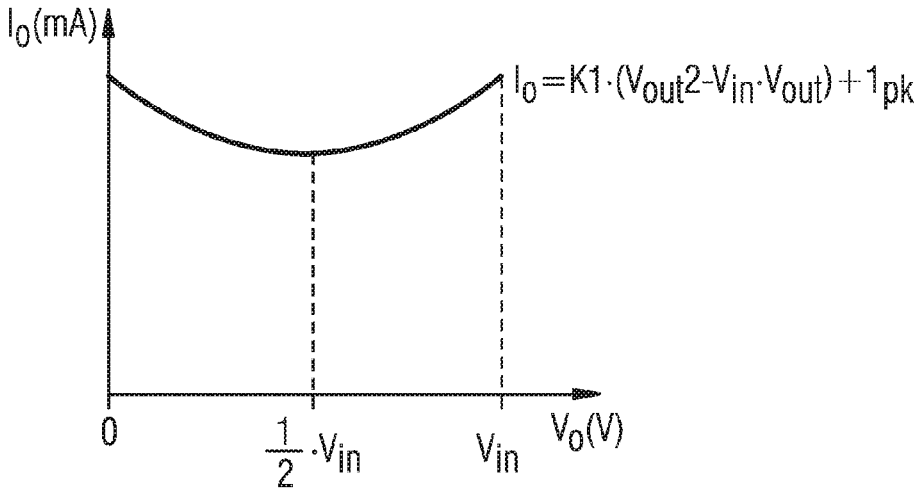
FIG. 2 is a chart showing a current-voltage relation of a related LED control circuit.
Figure 3:
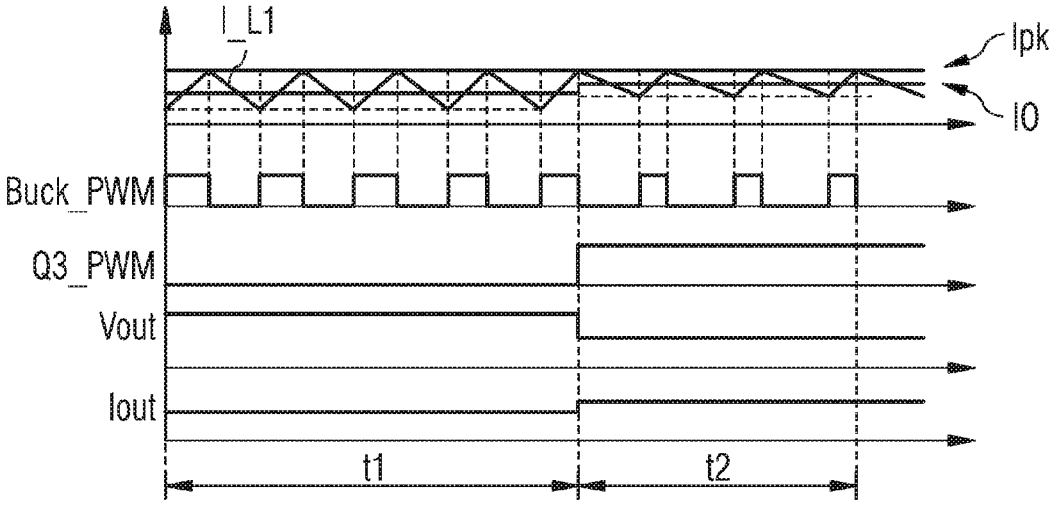
FIG. 3 is an oscillogram of a related LED control circuit.
Figure 5:
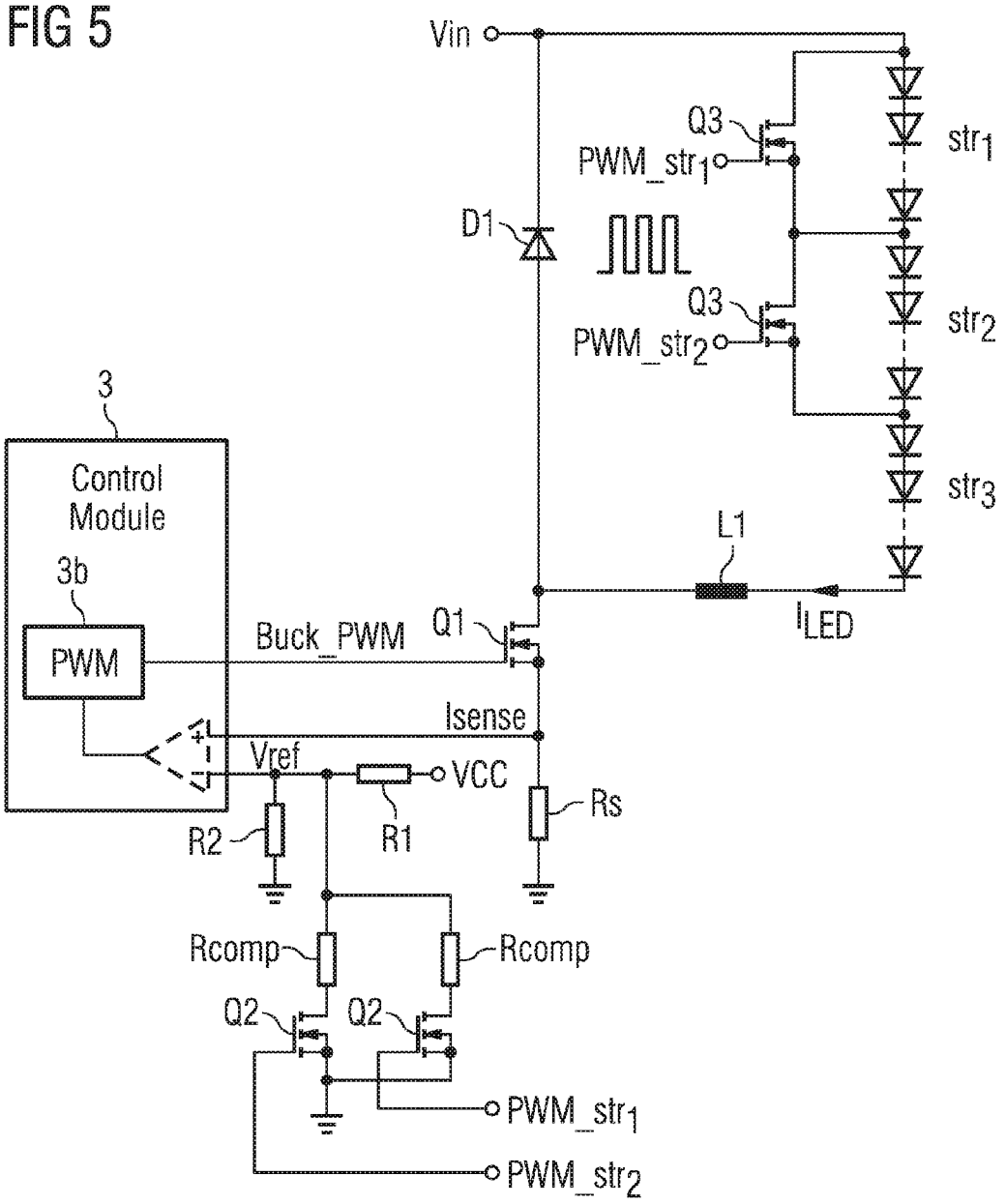
FIG. 5 is a circuit diagram of a first embodiment of the LED control circuit according to the present disclosure.

FIG. 5 is a circuit diagram of a first embodiment of the LED control circuit according to the present disclosure. According to the chart shown in FIG. 2, assume that when an actual input voltage is smaller than half of the input voltage shown in the chart, the working current flowing through the load groups presents a rising trend; and when an actual input voltage is larger than half of the input voltage shown in the chart, the working current flowing through the load groups presents a descending trend. The first embodiment shown in FIG. 5 corresponds to the situation where the actual input voltage is larger than half of the input voltage shown in the chart, then the working current flowing through the load groups presents a rising trend, and in conjunction with Formula (4), the working current $I_o$ of the load groups $str_1, \ldots, str_n$ can be assured to keep constant by decreasing the peak current $I_{pk}$.

It can be seen from FIG. 5 that the control module 3 of the LED control circuit according to the present disclosure comprises: a comparator 3*a* configured to compare the sample voltage $V_{sense}$ with the reference voltage $V_{ref}$; and a pulse width modulator 3*b*, connected with an output of the comparator 3*a*, configured to generate a PWM signal as the control signal BUCK_PWM according to the comparison result. The reference voltage compensating module 5 comprises a plurality of reference voltage compensating sub-modules in parallel connection with each other, wherein respective reference voltage compensating sub-module corresponds to one switch of the load short circuit module 4 (in the present embodiment, respective switch is configured to be MOSFET) and respective reference voltage compensating sub-module and corresponding switch thereof are simultaneously controlled by the same switching signal.

As can be further seen from FIG. 5, a reference voltage compensating sub-module comprises a second transistor Q2 and a compensating resistor $R_{comp}$, wherein the second transistor Q2 has a control Electrode receiving the switching signal $PWM_str_1, \ldots, PWM_str_n$, a working Electrode connected to a inverting input of the comparator 3*a* via the compensating resistor $R_{comp}$, and a reference Electrode connected to ground. The reference voltage $V_{ref}$ is lowered down when the second transistor Q2 is turned on in response to the switching signal $PWM_str_1, \ldots, PWM_str_n$, and the peak current $I_{pk}$ also decreases, so that the compensation is accomplished, and outputting a constant working current $I_o$.

Besides, the conversion module 1 of the LED control circuit according to the present disclosure comprises a first transistor Q1, an inductor L1 and a diode D1, wherein the first transistor Q1 has a control Electrode receiving the control signal BUCK_PWM, a reference Electrode connected to ground via the reference resistor $R_s$, and a working Electrode connected to a node between an anode of the diode D1 and one end of the inductor L1, a cathode of the diode D1 and an input end of serially connected load groups $str_1, \ldots, str_n$ are connected with the input voltage $V_{in}$, respectively, and the other end of the inductor L1 is connected with an output end of the serially connected load groups $str_1, \ldots, str_n$.

In addition, the reference voltage generating module 2 of the LED control circuit according to the present disclosure comprises a DC voltage source $V_{cc}$, a first resistor R1 and a second resistor R2, wherein the first resistor R1 has one end connected to the DC voltage source $V_{cc}$ and the other end connected to the inverting input of the comparator 3*a*; the second resistor R2 has one end connected to a node between the inverting input and one end of the first resistor R1 and the other end connected to ground; a non-inverting input of the comparator 3*a* is connected to a node between the reference Electrode of the first transistor Q1 and the reference resistor $R_s$, and the sample current $I_{sense}$ generates the sample voltage $V_{sense}$ after flowing through the reference resistor $R_s$. At the same time, the switch of the load short circuit module 4 of the LED control circuit according to the present disclosure is configured to be a third transistor Q3 that has a control Electrode receiving the switching signal $PWM_str_1, \ldots, PWM_str_n$, a working Electrode connected to an input end of one load group $str_1, \ldots, str_n$, and a reference Electrode connected to an output end of one load group $str_1, \ldots, str_n$.

Figure 6:
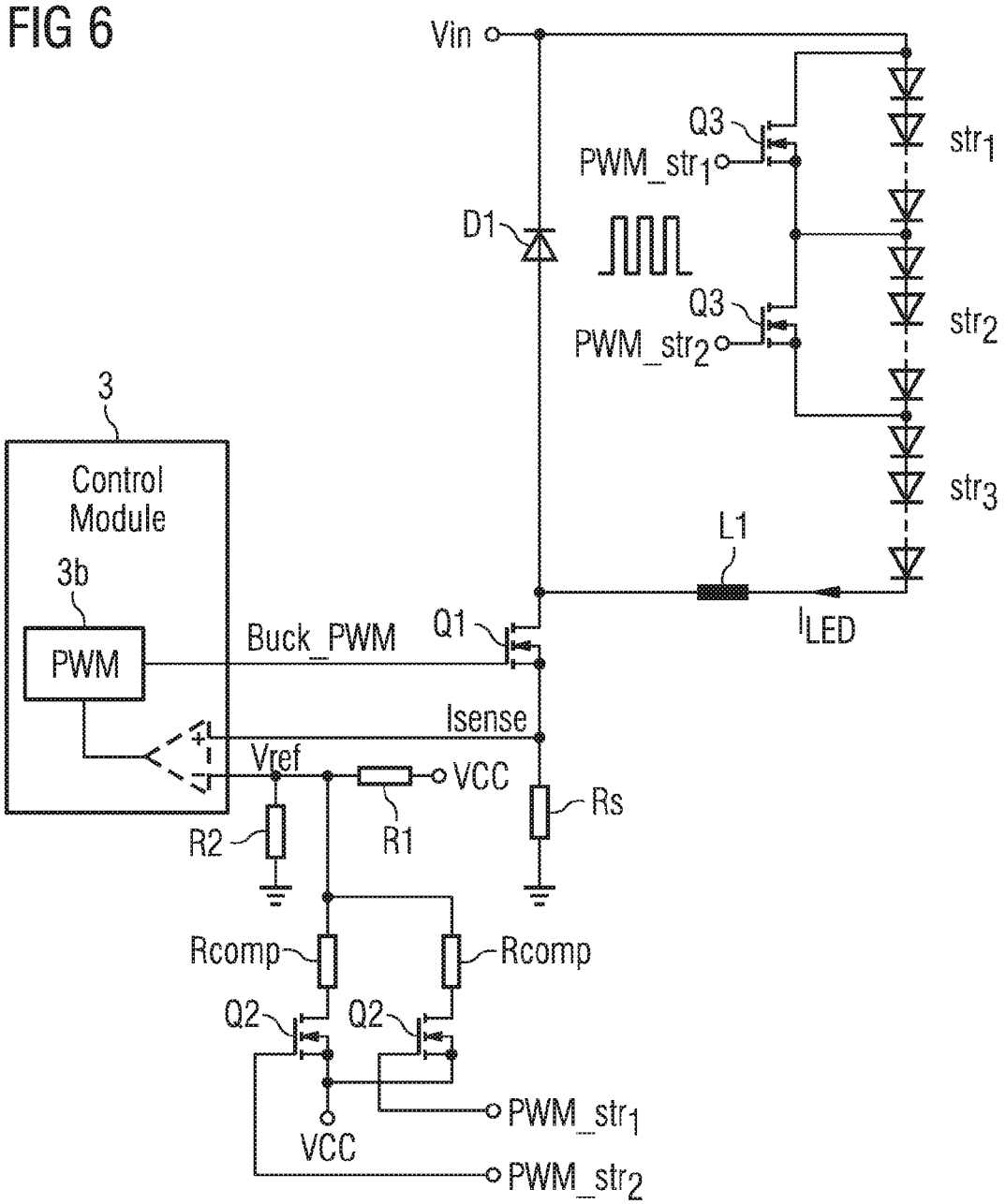
FIG. 6 is a circuit diagram of a second embodiment of the LED control circuit according to the present disclosure.

FIG. 6 is a circuit diagram of a second embodiment of the LED control circuit according to the present disclosure. In this embodiment, assume that when an actual input voltage is smaller than half of the input voltage shown in the chart, the working current flowing through the load groups presents a descending trend. Similarly in conjunction with Formula (4), the working current $I_o$ of the load groups $str_1, \ldots, str_n$ can be assured to keep constant by increasing the peak current. The second embodiment shown in FIG. 6 differs from the first embodiment shown in FIG. 5 merely in the reference voltage compensating module. In the second embodiment, respective reference voltage compensating sub-module of the reference voltage compensating module 5 comprises a second transistor Q2 and a compensating module $R_{comp}$, wherein the second transistor Q2 has a control Electrode receiving the switching signal $PWM_str_1, \ldots, PWM_str_n$, a working Electrode connected to a inverting input of the comparator 3*a* via the compensating module $R_{comp}$, and a reference Electrode connected to the DC voltage source $V_{cc}$. The DC voltage source $V_{cc}$ compensates the reference voltage $V_{ref}$ when the second transistor Q2 is turned on in response to the switching signal $PWM_str_1, \ldots, PWM_str_n$, and the peak current $I_{pk}$ also increases, so that the compensation is accomplished and outputting a constant working current $I_o$.

In one solution of the present disclosure, respective load group is configured to be LED string on which a short circuit control is performed by, a switch configured to be MOSFET. In one solution of the present disclosure, three LED strings are used, wherein two are connected in parallel with the MOSFET performing the short circuit control thereon. But according to the principle of the present disclosure, multiple LED strings may be used, and each LED string may be connected in parallel with the MOSFET performing the short circuit control thereon.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SIGNS

1 conversion module
2 reference voltage generating module
3 control module
3*a* comparator
3*b* pulse width modulator
4 load short circuit module
5 reference voltage compensating module
$str_1, \ldots, str_n$ load group
$V_{in}$ input voltage
$V_{out}$ output voltage
$V_{sense}$ sample voltage
$V_{ref}$ reference voltage
$V_{comp}$ compensation voltage
$I_{sense}$ sample current
$I_o$ working current
$I_{pk}$ peak current
BUCK_PWM control signal
$PWM_str_1, \ldots, str_n$ switching signal.
Q1 first transistor
Q2 second transistor
Q3 third transistor
L1 inductor
D1 diode
$R_s$ reference resistor
R1 first resistor
R2 second resistor
R3 third resistor
$V_{cc}$ DC voltage source
$R_{comp}$ compensating resistor

The invention claimed is:

1. An LED control circuit for controlling an LED illuminating device, the LED illuminating device comprising at least two serially connected load groups, and the LED control circuit comprising:

a conversion module, for converting an input voltage into an output voltage for the load groups, and outputting a working current of the load groups which is sampled to obtain a sample current;

a reference voltage generating module for generating a reference voltage;

a control module for comparing a sample voltage corresponding to the sample current with the reference voltage, and outputting a control signal to the conversion module according to a comparison result; and a load short circuit module including a plurality of switches each connected in parallel with respective load group for performing a short circuit control on respective load group in response to a switching signal, wherein the LED control circuit further comprises a reference voltage compensating module for generating a compensation voltage for compensating the reference voltage in response to the switching signal.

2. The LED control circuit according to claim 1, wherein the control module comprises:

a comparator for comparing the sample voltage with the reference voltage; and a pulse width modulator, connected with an output of the comparator, for generating a PWM signal as the control signal according to the comparison result.

3. The LED control circuit according to claim 2, wherein the reference voltage compensating module comprises a plurality of reference voltage compensating sub-modules connected in parallel with each other, wherein respective reference voltage compensating sub-module is assigned to one switch of the load short circuit module, and respective reference voltage compensating sub-module and corresponding switch thereof are simultaneously controlled by the same switching signal.

4. The LED control circuit according to claim 3, wherein respective reference voltage compensating sub-module comprises a second transistor and a compensating resistor, wherein the second transistor has a control electrode receiving the switching signal, a working electrode is connected to an inverting input of the comparator via the compensating resistor, and a reference electrode is connected to ground.

5. The LED control circuit according to claim 3, wherein the reference voltage compensating sub-module comprises a second transistor and a compensating resistor, wherein the second transistor has a control electrode receiving the switching signal, a working electrode is connected to an inverting input of the comparator via the compensating resistor, and a reference electrode is connected to a DC voltage source.

6. The LED control circuit according to claim 2, wherein the conversion module comprises a first transistor, an inductor and a diode, wherein the first transistor has a control electrode receiving the control signal, a reference electrode connected to ground via a reference resistor, and a working electrode connected to a node between an anode of the diode and one end of the inductor, a cathode of the diode and an input end of the serially connected load groups are connected with the input voltage, respectively, and the other end of the inductor is connected with an output end of the serially connected load groups.

7. The LED control circuit according to claim 6, wherein the reference voltage generating module comprises a DC voltage source, a first resistor and a second resistor, wherein the first resistor has one end connected to the DC voltage source and the other end connected to an inverting input of the comparator; the second resistor has one end connected to a node between the inverting input and the one end of the first resistor and the other end connected to ground; a non-inverting input of the comparator is connected to a node between a reference electrode of the first transistor and the reference resistor, and the sample voltage is generated after the sample current flowed through the reference resistor.

8. The LED control circuit according to claim 2, wherein respective switch of the load short circuit module is configured to be a third transistor, wherein the third transistor has a control electrode receiving the switching signal, a working electrode connected to an input end of one of the load groups, and a reference electrode connected to an output end of one of the load groups.

9. A controlling method of an LED control circuit, wherein the method comprising:

converting an input voltage to an output voltage for load groups by means of a conversion module, and outputting a working current of the load groups which is sampled to obtain a sample current;

controlling a switch of a load short circuit module by means of a switching signal to perform a short circuit control on one or more of the load groups;

generating a reference voltage by means of a reference voltage generating module;

controlling a reference voltage compensating module by means of the switching signal to generate a compensation voltage for compensating the reference voltage; and comparing a sample voltage with compensated reference voltage by means of a control module, and adjusting a duty cycle of a control signal according to a comparison result so as to control a peak current flowing through the load groups, and outputting a constant working current.

10. The controlling method according to claim 9, wherein in said controlling the reference voltage compensating module, a second transistor of the reference voltage compensating module connected to ground is turned on in response to the switching signal, and further the compensation voltage decreasing the reference voltage is generated.

11. The controlling method according to claim 9, wherein in said controlling the reference voltage compensating module, a second transistor of the reference voltage compensating module connected to a DC voltage source is turned on in response to the switching signal, and further the compensation voltage increasing the reference voltage is generated.

* * * * *